US005637067A

United States Patent [19]

Ausmus

[11] Patent Number: 5,637,067

[45] Date of Patent: Jun. 10, 1997

[54] ATHLETIC SUPPORT DEVICE FOR THE CERVICAL-THORACIC REGION

[76] Inventor: Daniel G. Ausmus, 2172 Caper Tree, Tustin, Calif. 92680

[21] Appl. No.: 382,368

[22] Filed: Feb. 1, 1995

[51] Int. Cl.[6] ..... A63B 23/00

[52] U.S. Cl. ..... 482/140; 482/74

[58] Field of Search ..... 482/139, 140, 482/10, 148; 602/14, 18; 607/109

[56] References Cited

U.S. PATENT DOCUMENTS

| | | | |
|---|---|---|---|
| 3,810,466 | 5/1974 | Rogers | 602/18 |
| 3,850,164 | 11/1974 | Hare | 602/18 |
| 4,335,875 | 6/1982 | Elkin | 482/74 |
| 4,337,938 | 7/1982 | Rodriguez | 482/139 |
| 5,122,107 | 6/1992 | Gardner | 482/140 |
| 5,295,949 | 3/1994 | Hathaway | 482/10 |

*Primary Examiner*—Stephen R. Crow
*Attorney, Agent, or Firm*—Harold L. Jackson

[57] ABSTRACT

An athletic support device adapted to be used in assisting an individual to perform abdominal sit-ups without additional stress being placed on the cervical-thoracic region of the body. The support device includes a body member adapted to be positioned about the base the neck so as to brace the cervical-thoracic junction. The body member includes a pair of handle members, whereby the support device is held in place to assist the user while rising from a lying position to a sitting position when performing sit-up exercises.

8 Claims, 2 Drawing Sheets

ATHLETIC SUPPORT DEVICE FOR THE CERVICAL-THORACIC REGION

BACKGROUND OF THE INVENTION

Field of the Invention

This invention relates generally to an athletic support device and more particularly to an athletic support device for the cervical-thoracic region that is adapted to be used; in assisting an individual to perform abdominal sit-ups without additional stress being placed on the cervical-thoracic region of the body. The support device is designed to be positioned around the base of the back and side portion of the neck so as to brace the cervical-thoracic junction.

Abdominal sit-up exercises, if not done correctly or if done to extremes, can often lead to various injuries along the spinal column and more particularly in the segmented vertebrae located adjacent the cervical-thoracic junction of the spinal column. The cervical area is located in the neck of the body and includes seven cervical vertebrae which are smaller than those in any other region of the spine. The thoracic region which is located below the cervical vertebrae and is connected thereto at its upper end. The thoracic region which includes twelve dorsal vertebrae connects at its lower end to the lumbar vertebrae. As can be readily understood the cervical-thoracic region is a very complicated and delicate structure that is placed under considerable stress during many types of exercises, particularly during strenuous sit-up activities. Until now, no simple solution has been suggested or devised to prevent accidental injury during such exercises. Accordingly, the present invention as will hereinafter be disclosed has been designed to relieve the type of stress that often occurs during such exercises.

SUMMARY OF THE INVENTION

It is therefore an important object of the present invention to provide a relatively simple and easy to manufacture athletic support device that is formed as elongated pliable body member that can be comfortably located at the base of the neck by means of a suitable flexible strap or handle members which extend out from each end the body member, whereby the free ends of the strap or handle members are grasped by the user to assist in the raising of the upper torso to a sitting position by simultaneously pulling the support device without placing additional stress on the cervico-thoracic region or on the adjacent neck and upper back area.

Another object of the present invention is to provide an athletic support device to relieve additional stress on the cervical-thoracic region during sit-up exercises, wherein the body of the support device is formed from a substantially flat sponge like material that is enclosed within a suitable soft cover to which an elongated strap is fixedly attached, and wherein the opposite free ends of the strap are formed with handles for the user's hands to grasp.

Still another object of the present invention is to provide an athletic support device of this character wherein the body member is formed in a cylindrical configuration, wherein a strap or rope member extends outwardly therefrom and includes handle members attached thereto.

A further object of the invention is to provide a support device of this character that includes a brace member mounted to the central portion of the cylindrical body, the brace member being formed with a mounting strut having an upper extended end to which is mounted a neck engaging pad. At the lower opposite end there is mounted a larger thorax engaging pad that rests against the posterior surface which defines the twelve dorsal vertebrae.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts.

DESCRIPTION OF THE PREFERRED EMBODIMENT

Figure 1:
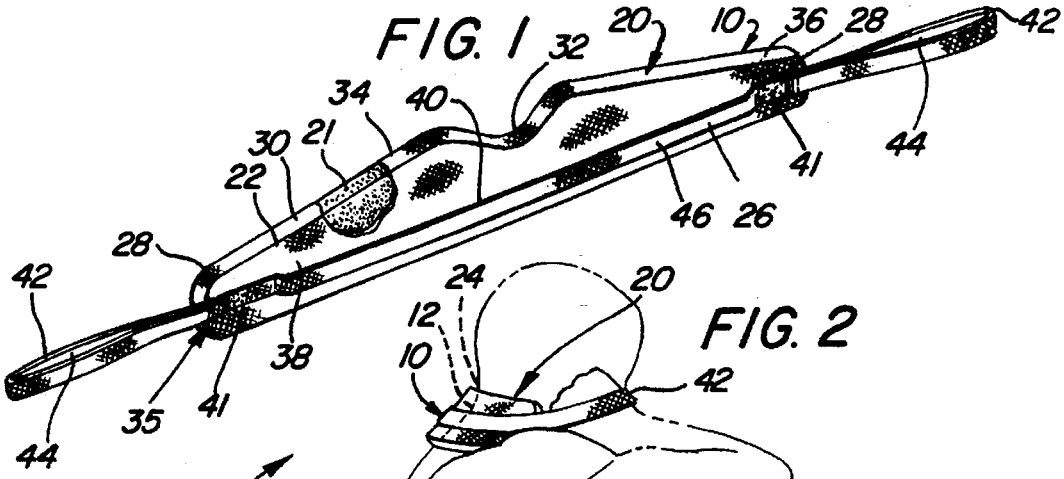
FIG. 1 is a perspective view of the present invention that illustrates the preferred embodiment of an athletic support device that relieves most of the stress that might be placed on the cervical-thoracic region during sit-up exercises.
Figure 2:
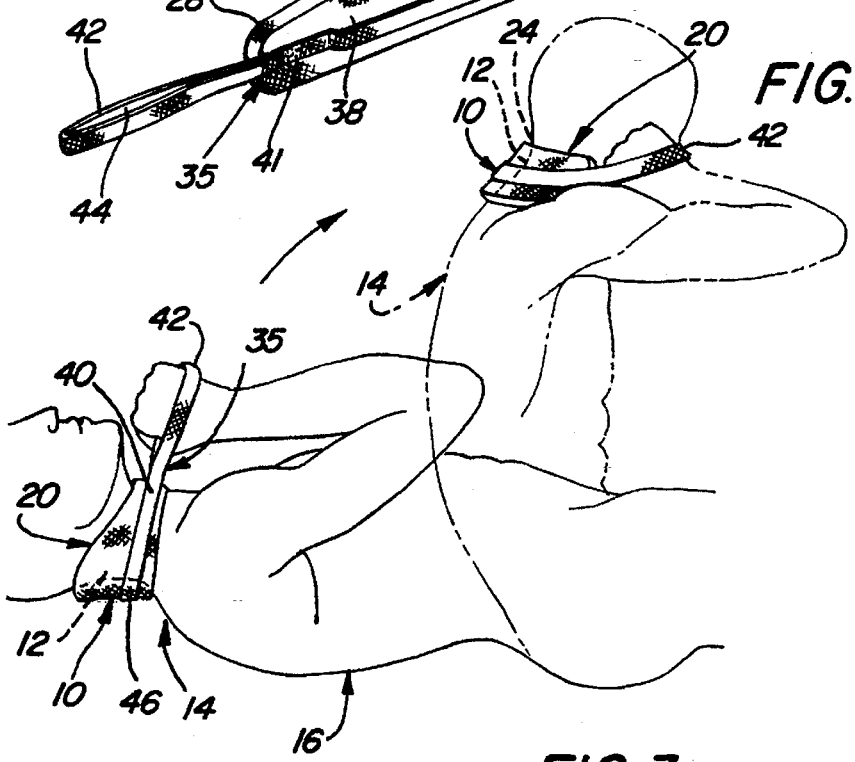
FIG. 2 is a diagrammatic view showing how the support device is positioned around the neck area of the user while in both a reclining position and an upright sitting position which indicated by phantom lines.
Figure 3:
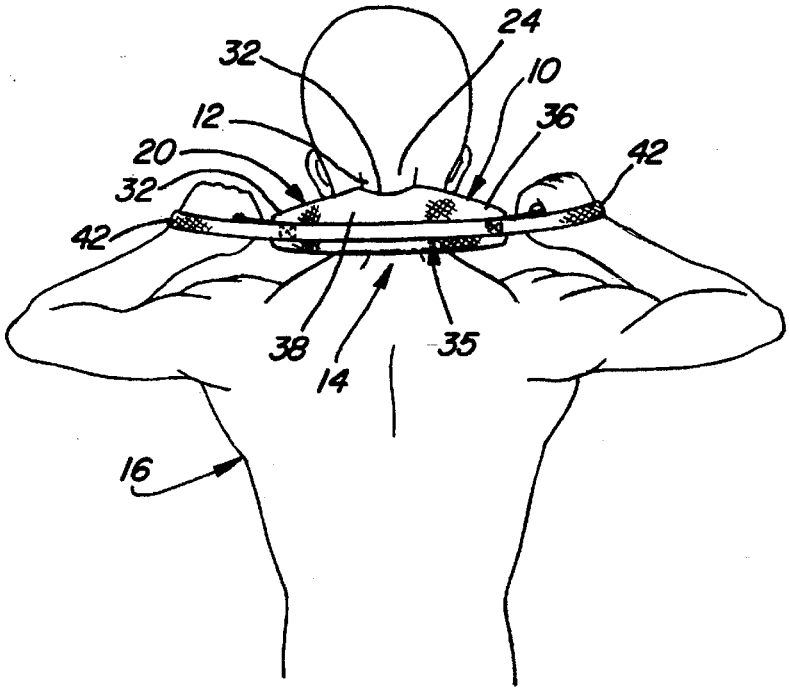
FIG. 3 is a rear view of the athletic support device positioned on the user's neck.

As shown in FIGS. 1, 2 and 3, one embodiment of the present invention is illustrated as defining an athletic support device, indicated at 10, which is designed to relieve stress in the cervical-thoracic region during strenuous exercises, more particularly sit-up exercises during which a person lying flat on his or her back rises to a sitting position without the using the hands.

The cervical region is more commonly referred to as the neck area 12 and the thoracic region is generally referred as the upper back area 14 between the shoulders, as indicated at 16. As mentioned heretofore these areas are structurally complicated and can be easily over-stressed whereby serious injury can occur.

The support device 10 comprises an elongated main body member 20 that is formed from a pliable material 21 such as foam rubber or plastic. Body member 20 is covered with an outer sheet of suitable soft cloth 22 or the like, as more particularly illustrated in FIG. 1. Accordingly, body member 20 can be made in any suitable shape, but is herein shown as having a configuration that is particularly adapted to conform to the back and side areas of one's neck line 12 and to the base of the head 24.

The length of body member 20 is approximately 16 to 20 inches and the width of approximately 3 to 4 inches if made in simple rectangular configuration. However, the preferred form is illustrated in FIG. 1, wherein the configuration is more suitable to correspond to the average persons neckline. That is, the lower edge 26 of body member 20 extends substantially flat along the full length between the oppositely disposed ends 28. The upper edge 30 is formed in a particular configuration wherein the central portion of the body member has a width between 3 to 4 inches and includes a curved recess 32 adapted to receive the central portion of neck 12, as illustrated in FIG. 3. Thus, the upper edge 30 is defined by the centrally disposed recess 32 with oppositely arranged inclined surfaces 34 and 36 that taper downwardly and outwardly from the respective sides of recess 32 terminating at each oppositely disposed end 28. Such a configuration is designed so as not to interfere with one's ears or face.

A handle means, generally indicated at 35, is suitably attached to the rear wall 38 of the body member 20 and comprises an elongated strap 40 that is attached adjacent the opposite ends 28 of the body member 20, as seen in FIG. 1, by suitable means 41 such as by sewing or by the use of Velcro® like material.

Strap 40 extends beyond each end 28 so as to define handles 42 which are provided by overlapping the ends of the strap so as to form a pair of looped ends 44. When using support device 10 the user grasps the looped ends 44, as indicated in FIGS. 1–3, and thereby holds the athletic support device 10 firmly against the neck.

It should be noted that when strap 40 is secured in place so to define an intermediate section 46, thereby preventing material 21 and cover 22 from stretching longitudinally as body support is pulled during the sit-up exercises.

Figure 4:
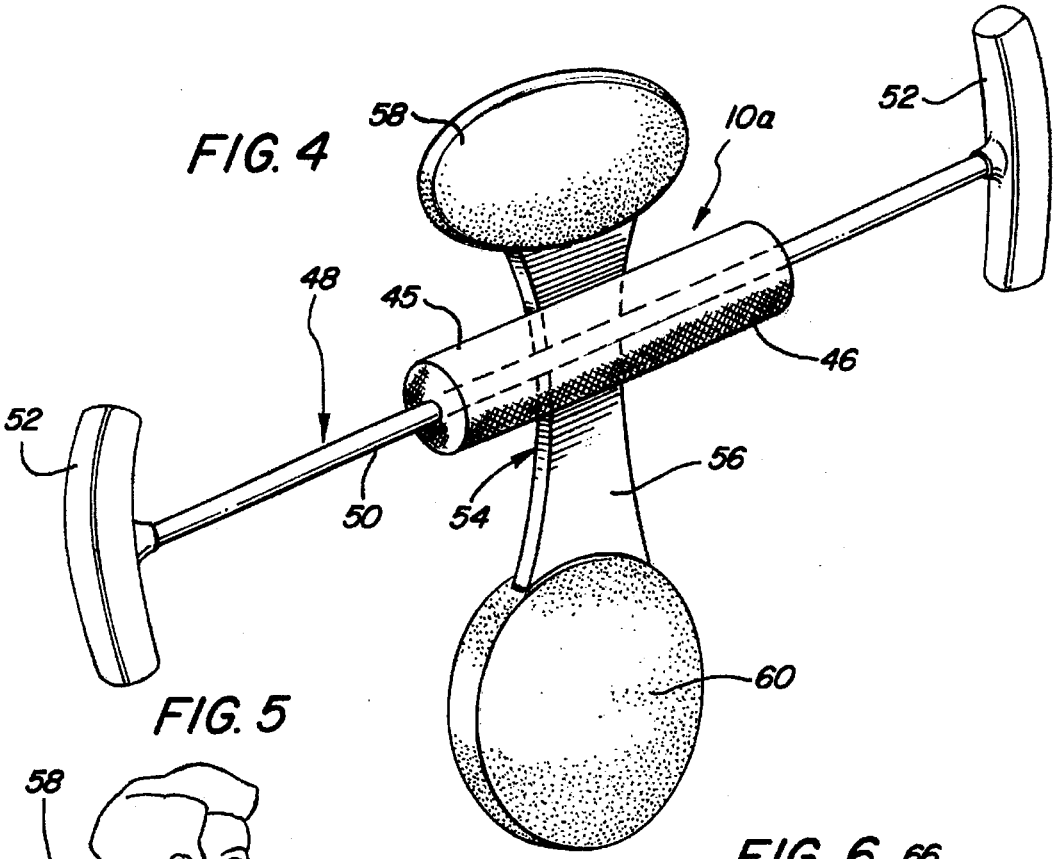
FIG. 4 is an alternative embodiment of the invention including a neck and back brace.
Figure 5:
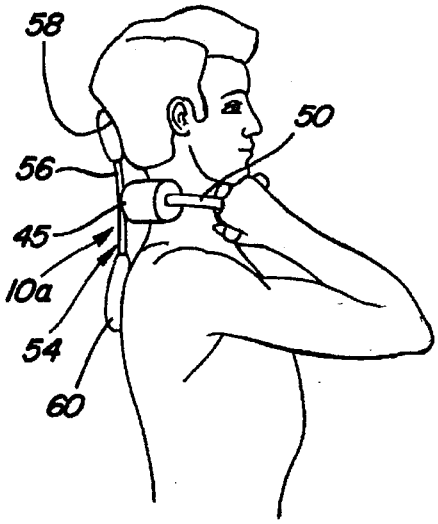
FIG. 5 is a side-elevational view of the support device as seen in FIG. 4 and mounted to show the braced areas between the neck and upper back of the user.

Referring now to a first alternative embodiment of the invention, there is shown in FIGS. 4 and 5 a support device **10*a* which has a body member 45 made from suitable flexible material, such as foam rubber or plastic. The body member 45 in this embodiment is formed in an elongated cylindrical configuration and is preferably covered with a suitable soft cloth 46**.

A handle means, indicated at 48, is mounted to the: cylindrical body member 45, and comprises a strap member defined by a flexible cord 50 or the like that extends through the center axis of the cylindrical body and projects outwardly from each end so as to be provided with handle bars 52 mounted to the opposite ends of cord 50.

Fixedly attached to body member 45 is a bracing means, designated generally at 54, that comprises a vertical strut 56 mounted to the central portion of body member 45, a head pad 58 being mounted to the upper end of the strut to engage and support the user's head. Head pad 58 can be of any suitable configuration but is herein shown in an elliptical shape so as to cover a broader area across the back of the neck. A thoracic pad 60 is mounted to the lower end of the strut 56 and can also be in any suitable configuration, but is shown herein as being circular in shape. This second pad defines a back support pad which engages the back of the user between the shoulders so as to be positioned over the thoracic region of the body. Accordingly, body member 45 supports the cervical region as heretofore mentioned.

Figure 6:
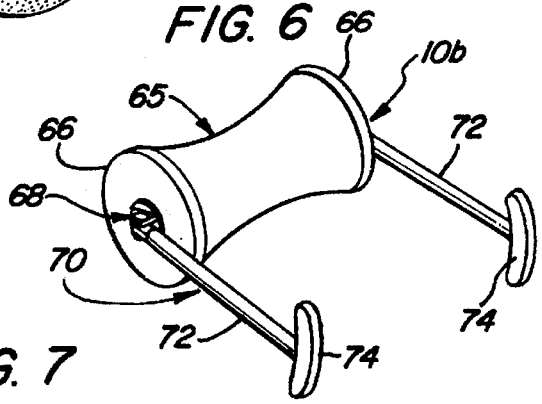
FIG. 6 is a perspective view of another embodiment of the present invention.
Figure 7:
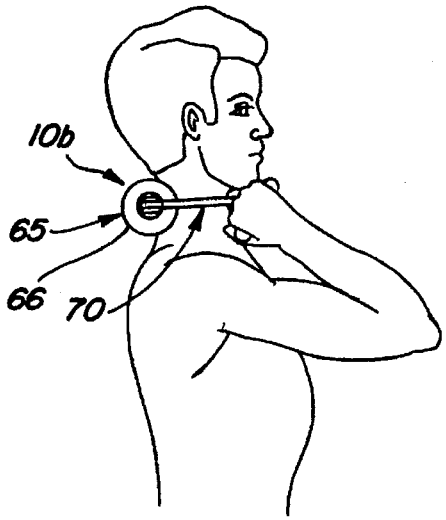
FIG. 7 is a pictorial view showing the embodiment of FIG. 6 mounted about the neck of a user thereof.

A second alternative embodiment is shown in FIGS. 6 and 7, which shows the support member **10*b* formed as a pliable body member 65 with a substantially concave cylindrical configuration. Each end of the body member is provided with end plates 66 of suitable material on which are affixed hinge means, generally indicated at 68. Handle means, indicated at 70, are hingedly attached to the oppositely disposed hinge means 68, the handle means comprising an extended arm member 72 to which is fixedly attached a handlebar 74**.

The concave configuration of body member 65 allows the back of one's neck to fit very comfortably within the concave portion of the body member 65.

The foregoing should only be considered as illustrative of the principles of the invention. Further, since numerous modifications and changes may readily occur to those skilled in the art, it is not desired to limit the invention to the exact construction and operation as shown and described, and accordingly, all suitable modifications and equivalents may be resorted to, falling within the scope of the claimed invention.

What is claimed is:

1. An athletic support device arranged to be applied to the cervical-thoracic region of one's body to prevent stress during strenuous sit-up exercises, wherein the device comprises:

a body member having a substantially rectangular configuration with a length within the range of about 12 to 16 inches and a width within the range of about 3 to 4 inches and being formed from a pliable material to conform to the area around the user's neck, the body member having a front wall adapted to be placed in contact with a user's neck and a rear wall on the opposite side thereof;

a cover enclosing said body member therein; and an elongated strap secured along the rear wall of the body member and extending from the opposite ends thereof, the ends of the strap being looped to form handles adapted to be grasped by the user, the strap being nonstretchable for preventing the body member from stretching longitudinally as the ends of the strap are pulled during sit-up exercises.

2. The athletic support device as recited in claim 1, wherein said body member is formed having a substantially flat lower edge extending longitudinally along the full length thereof, and an upper edge having a curved recess formed within said upper edge so as to be positioned in the central portion of said body member to receive the rear neck portion of the user, and wherein said upper edge includes a pair of inclined surfaces tapered downwardly and outwardly from the respective sides of said curved recess and terminating at each oppositely disposed end of said body member.

3. The athletic support device as recited in claim 1, wherein said body member is formed in a substantially cylindrical configuration and wherein said handle means comprises an elongated cord mounted through said body member with said free ends extending outwardly along the axis of said body member, a pair of handles, each being fixedly attached to the respective ends of said cord.

4. The athletic support device as recited in claim 3, wherein said body member includes a cervical-thoracic brace means secured to the central portion of said body member so as to engage both the cervical and thoracic regions of the user's body.

5. The athletic support device as recited in claim 4, wherein said cervical-thoracic brace means comprises:

a strut member vertically secured to the central portion of said body member so as to define an upper end and a lower end;

a head brace member mounted to said upper end of said strut member so as to be positioned for engagement with the head of the user; and a thoracic brace member mounted to said lower end of said strut member so as to be positioned against the thoracic region of the user's back.

6. The athletic support device as recited in claim 5, wherein said head brace member is defined by an elliptical pad, and wherein said thoracic brace member is defined by a circular pad.

7. The athletic support device as recited in claim 1, wherein said body member is formed in a substantially concave cylindrical configuration to receive the neck of the user therein;

a pair of end plates, each mounted to the opposite ends of said body member;

hinge means affixed to said end plates; and handle means, hingedly attached to the oppositely disposed hinge means.

8. The athletic support device as recited in claim 6, wherein said handle means comprises a pair of extended arm members, each being hingedly connected to said hinges means, and wherein each of said arm members includes a handle bar fixedly attached thereto.

* * * * *